US011278945B2

(12) United States Patent
Kato et al.

(10) Patent No.: US 11,278,945 B2
(45) Date of Patent: Mar. 22, 2022

(54) DIE SET AND WORKING METHOD USING THE DIE SET

(71) Applicants: NIKKEIKIN ALUMINIUM CORE TECHNOLOGY COMPANY LTD., Tokyo (JP); NIPPON LIGHT METAL COMPANY, LTD., Tokyo (JP); HORIKAWA INDUSTRY CO., LTD., Komatsu (JP)

(72) Inventors: Mitsunori Kato, Niigata (JP); Toshiaki Yamazaki, Tokyo (JP); Eiji Anzai, Shizuoka (JP); Shoichi Horikawa, Ishikawa (JP); Hiroyuki Horikawa, Ishikawa (JP)

(73) Assignees: NIKKEIKIN ALUMINUM CORE TECHNOLOGY COMPANY, LTD., Tokyo (JP); NIPPON LIGHT METAL COMPANY, LTD., Tokyo (JP); HORIKAWA INDUSTRY CO. LTD., Komatsu (JP)

( * ) Notice: Subject to any disclaimer, the term of this patent is extended or adjusted under 35 U.S.C. 154(b) by 69 days.

(21) Appl. No.: 16/481,953

(22) PCT Filed: Jan. 31, 2018

(86) PCT No.: PCT/JP2018/003295
§ 371 (c)(1),
(2) Date: Jul. 30, 2019

(87) PCT Pub. No.: WO2018/143302
PCT Pub. Date: Aug. 9, 2018

(65) Prior Publication Data

US 2020/0038932 A1 Feb. 6, 2020

(30) Foreign Application Priority Data

Jan. 31, 2017 (JP) ..... JP2017-016251

(51) Int. Cl.
*B21D 5/02* (2006.01)
*B21D 37/10* (2006.01)

(52) U.S. Cl.
CPC ..... *B21D 5/0209* (2013.01); *B21D 37/10* (2013.01)

(58) Field of Classification Search
CPC . B21D 5/00; B21D 5/002; B21D 5/01; B21D 5/02; B21D 5/0209; B21D 5/0281;
(Continued)

(56) References Cited

U.S. PATENT DOCUMENTS 3,566,661 A * 3/1971 McCafferty ..... B21D 5/08 72/220
3,613,427 A * 10/1971 Haddon ..... B21D 5/01 72/212

(Continued)

FOREIGN PATENT DOCUMENTS

| | | |
|---|---|---|
| JP | 50-2923 | 1/1975 |
| JP | H08-24960 | 1/1996 |
| JP | H09-94615 | 4/1997 |
| JP | H09-295052 | 11/1997 |
| JP | 2007-105743 | 4/2007 |
| JP | 2014-108444 | 6/2014 |

OTHER PUBLICATIONS

International Search Report, dated Apr. 24, 2018 (dated Apr. 24, 2018), 2 pages.

*Primary Examiner* — Adam J Eiseman
*Assistant Examiner* — Matthew Stephens
(74) *Attorney, Agent, or Firm* — Rankin, Hill & Clark LLP

(57) ABSTRACT

A die set for bending a metal plate workpiece includes a lower die for placing the workpiece, an upper die having a pressing surface which presses the workpiece toward the lower die by movement, a lower movable part provided in the lower die and being slidable in the same direction as the direction of the upper die movement, and a gas spring
(Continued)

elastically supporting the lower movable part from below. The pressing surface of the upper die is moved, contacts with the upper surface of the workpiece and presses the workpiece toward the lower die. The lower movable part being elastically supported by the gas spring from below brings an opposing surface into contact with the lower surface of the workpiece and makes the upper die to be close to the lower die while applying force in the upward which is opposite direction of the upper die movement.

11 Claims, 12 Drawing Sheets

(58) Field of Classification Search
CPC ..... B21D 37/10; B21D 37/12; B21D 24/02; B21D 35/007
USPC ..... 72/352, 389.3, 453, 13
See application file for complete search history.

(56) References Cited

U.S. PATENT DOCUMENTS 4,192,170 A * 3/1980 Ferwagner ..... B21C 37/286 72/414
4,590,783 A * 5/1986 Tanaka ..... B21D 13/02 72/348
7,401,491 B2 * 7/2008 Leland ..... B21D 5/0209 72/389.3
7,584,640 B1 * 9/2009 Liu ..... B21D 5/02 72/387
2001/0010167 A1 * 8/2001 Leek ..... E04B 1/2608 72/379.2
2014/0271337 A1 * 9/2014 Banik ..... C22C 19/051 420/448
2015/0231682 A1 * 8/2015 Fujii ..... B21D 22/00 72/352
2016/0375477 A1 * 12/2016 Tanaka ..... B21D 5/01 72/356

* cited by examiner

DIE SET AND WORKING METHOD USING THE DIE SET

TECHNICAL FIELD

The present invention relates to die set and a working method using the die set.

BACKGROUND ART

Among prior dies and working methods using the dies intended for bending plate-like workpiece, there is a known method which a metal sheet material as a workpiece is placed on a grooved die (stationary unit) and is pressurized with a punch (moving unit) from the above. The work has conventionally been bent into a desired geometry in this way (see Patent Literatures 1 and 2).

According to a method described in Patent Literature 1, the workpiece is prevented from getting scratched on the surface, by fitting an insert member made of a material that excels in lubricating performance to the die, when bending the work. Meanwhile, Patent Literature 2 describes a press machine for drawing, having a blank holder ring that is disposed in a vertically movable manner, and a cushion pin that holds the blank holder ring. Such machine can suppress wrinkle from generating, by controlling the load of blank holder on the basis of difference between pressure applied to the upper die and pressure applied to the cushion pin during pressing.

CITATION LIST

Patent Literature

Patent Literature 1: JP-A-H09-094615
Patent Literature 2: JP-A-H08-024960

DISCLOSURE OF INVENTION

Technical Problem

One of recently known bent products is obtained by bending sheet-like, metal-based composite materials typically composed of aluminum or other metal and ceramic. Among the metal-based composite materials, especially a composite material composed of aluminum and ceramic, is less ductile when used as the workpiece. Hence, when bent by the prior methods, such material is likely to cause rupture or crack on the outer side of the bent portion, due to tensile stress (also referred to as "tension", hereinafter) that acts thereon, and likely to produce wrinkle on the inner side of the bent portion due to compressive stress that acts thereto.

For a case where such metal-based composite material (workpiece) is worked, the method described in Patent Literature 1 would rupture the workpiece when pressurizing it with the upper punch, due to tension generated from the origination point of bending along the outer side face. Meanwhile, the method described in Patent Literature 2 enables working without producing tension during pressurizing, by changing a loading pattern. The tension that generates at the origination point of bending of workpiece can, however, accumulate in a gap that resides between the punch and the die, making it likely to rupture the workpiece. It is therefore an object of the present invention to provide a die set capable of suppressing rupture or wrinkling of the workpiece during bending, and a working method using such die set.

Solution to Problem

The present invention provides a die set used for bending a metal plate workpiece, the die set include:

a lower die on which the workpiece is placed; and an upper die with a pressing surface that pressurizes the workpiece against the lower die, the lower die includes:

a lower movable part that is slidable in the same direction as the moving direction of the upper die;

a reaction force generating member that elastically supports the lower movable part from below; and receiving members that are positioned at both end parts of the lower movable part.

Advantageous Effects of Invention

According to the present invention, the lower movable part is elastically supported from below by the reaction force generating member. By moving the upper die downwards so as to press the workpiece under the pressing surface, the workpiece is pressed against the lower die, while the compressive load is applied from the top and from the bottom, thus enabling bending. Hence a die set and a working method using the die, which may prevent a metal plate from rupturing and wrinkling of the workpiece during bending, are successfully provided.

The reaction force generating member is composed using a gas spring. The reaction force generating member can therefore exert relatively strong initial reaction force as compared with other reaction force mechanisms such as spring, making it possible to tightly hold the workpiece between the upper die and the lower die. As the length of a piston outside of a cylinder becomes shorter by compression, reaction force created by a gas inside a cylinder increases, making it possible to increase the reaction force to be applied by the lower movable part to the workpiece. Hence, as the lower movable part of the lower die slides downwards, upward reaction force from the gas spring increases, so that it now becomes possible to gradually increase the clamping force applied to the workpiece from the top and from the bottom (thickness direction), as the upper die is pressurized against the workpiece. As a consequence, while the lower movable part slides downwards, the workpiece can be held under a level of force enough to avoid slippage between the workpiece and the dies.

The reaction force generated by the gas spring is less likely decline, even after compressed a large number of times in repetitive bending process using the die set. What is better, the gas spring is easy to install, and can save the running cost. The reaction force created by the gas spring enables stable bending process which is less likely to cause variation. Hence, use of the gas spring can facilitate operations regarding overall setting of a bending machine.

A plurality of gas springs may be arranged along the longitudinal direction of the lower die. Hence, even the workpiece has a long shape, uniform reaction force can be created over the longitudinal direction, making it possible to bend the workpiece evenly at every point in the longitudinal direction. With such plurality of gas springs arranged in the longitudinal direction of the lower die, it now becomes possible to construct the die set having a length suited to the longitudinal direction of the workpiece.

The gas springs are made adjustable in reaction force. This enables to suitably set a necessary level of reaction force, depending on size or strength of the workpiece, or pressurizing force of the upper die, and to create the reaction force enough to cope with bending stress necessary for the bending process.

The pressing surface of the upper die is curved in convex shape, meanwhile an opposing surface of the lower movable part, which is opposite to the pressing surface, has a concave portion that extends in the longitudinal direction, with a cross section curved in an arc shaped. A radius of curvature of the concave portion is equal to or larger than a radius of curvature of the convex surface of the pressing surface. This successfully enlarges contact areas of the workpiece with the pressing surface and with the opposing surface, so that the workpiece that is compressed between the pressing surface and the opposing surface will have inside and outside surfaces with desired radii of curvature and shapes.

Each radius of curvature of both end parts of the opposing surface is set to smaller than the radius of curvature of the adjacent edge parts of the lower die. This successfully shrinks each space formed while being surrounded by three members namely each end part of the lower movable part, each edge part and the workpiece, and can reduce the tension that possibly accumulates in this space. Hence the workpiece can be embraced, while suitably suppressing slippage of the workpiece.

The present invention also successfully prevents the workpiece from rupturing or wrinkling during bending process.

An underlay sheet made of metal is set on the top surface of the lower die, the workpiece is then placed on the underlay sheet, and the upper die is allowed to descend, so as to start the bending. In particular, bending stress exerted on the workpiece becomes maximum when the lower movable part reached the lowest point, and at this time, the tension created at the lower surface of the workpiece (outer surface when viewed in the direction of bending) becomes maximum. A region where the tension is created is over the outer surface of the workpiece. Hence by disposing the underlay sheet on the outer side of the workpiece, the region where the tension is created may be shifted towards a part of the underlay sheet. This contributes to further prevent the workpiece from rupturing or wrinkling.

DESCRIPTION OF EMBODIMENTS

Figure 1:
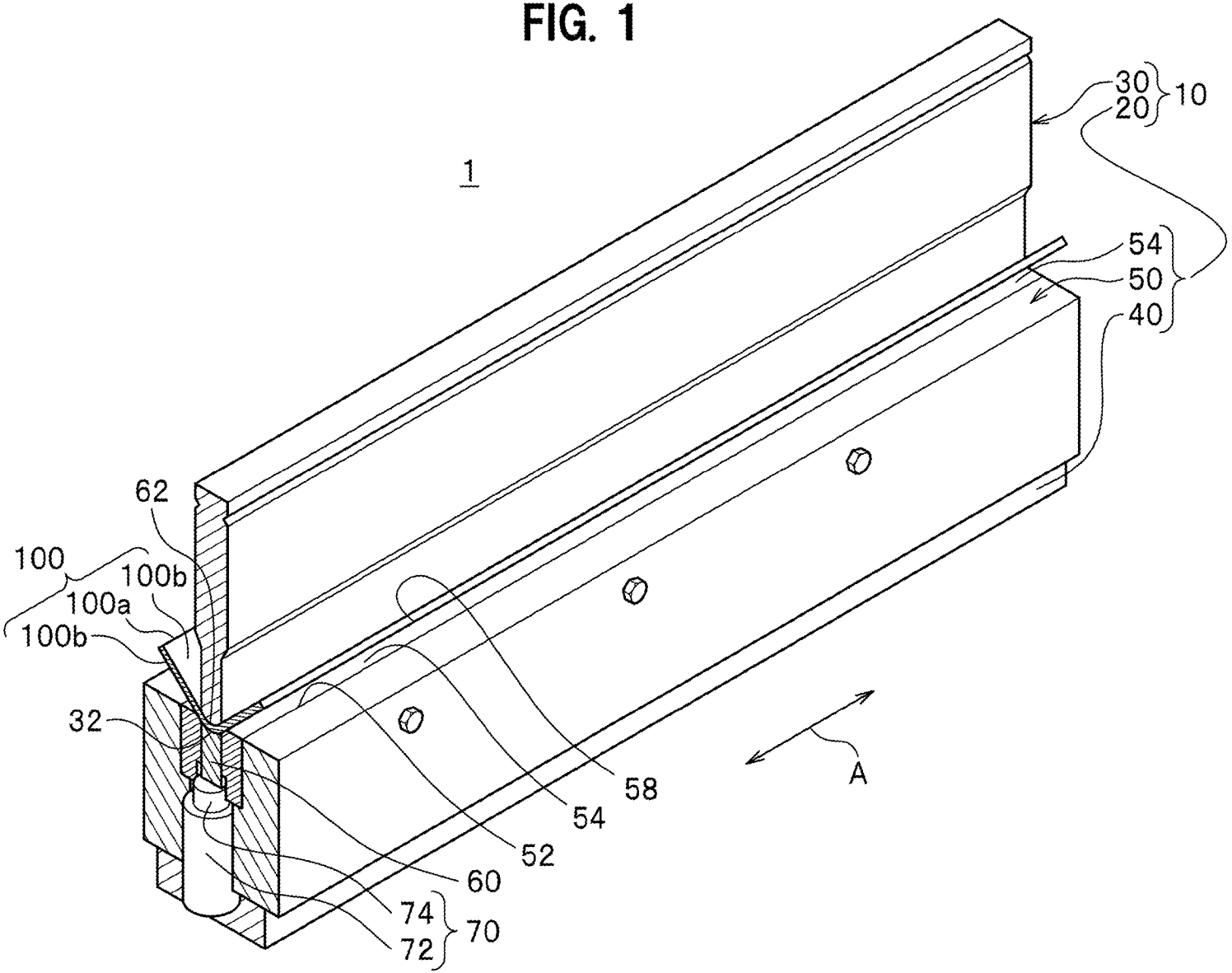
FIG. 1 is a perspective view illustrating an overall structure, regarding a die set and a working method using such die set according to Embodiment 1 of the present invention.

Embodiments of the present invention will be explained below, appropriately referring to the drawings. All identical constituents will have the same reference signs, and therefore will not be explained repetitively. FIG. 1 is a perspective view illustrating dies 10 used for a bending machine 1 of Embodiment 1. The dies 10 of Embodiment 1 are used for bending a plate-like workpiece 100. The dies 10 have a lower die 20 on which the workpiece 100 is placed, and an upper die 30 with a pressing surface 32 that pressurizes the workpiece 100.

The workpiece 100 is mainly composed of a core part 100*a* in the form of flat sheet before being worked, and skin parts 100*b*, 100*b* provided on the top and rear surfaces of the core part 100*a*. The core part 100*a* in Embodiment 1 is composed of aluminum powder and tungsten powder, or a mixed material containing boron (B4C), and has a shielding performance against radiation ray or neutron beam. This sort of composite material is less ductile as compared with aluminum alloy.

On both sides of the core part 100*a*, are laminated with skin parts 100*b* which is nearly equal surface area to core part 100*a*. The skin parts 100*b* are provided so as to respectively cover the top and rear surfaces of the core part 100*a* nearly over the entire range. The skin part 100*b* in Embodiment 1 is composed of an aluminum alloy that excels in ductility. Each of the skin parts 100*b*, 100*b* is formed so as to be thinned as compared with the core part 100*a*.

The upper die 30 is made movable upwards and downwards, with the aid of an unillustrated drive mechanism. At the lower end part of the upper die 30, there is formed the pressing surface 32 that opposes to the lower die 20. When the upper die 30 is retracted upwards and in a standby position, a certain space between the upper die 30 and the top surface of a receiving member 54 composing the lower die 20 is formed. When the upper die 30 is brought down to a pressurizing position, the pressing surface 32 at the lower end is partially inserted into or brought into proximity to a slit part 58 that is formed in the lower die 20.

Figure 2:
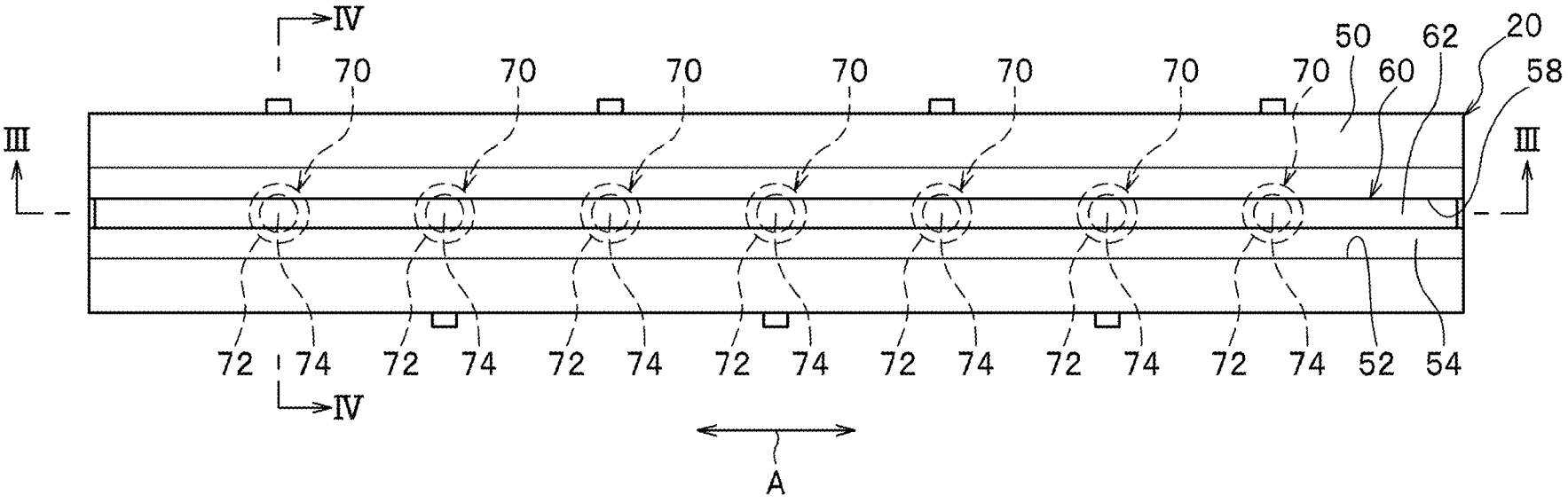
FIG. 2 is a top view illustrating a lower die of the die set.
Figure 4:
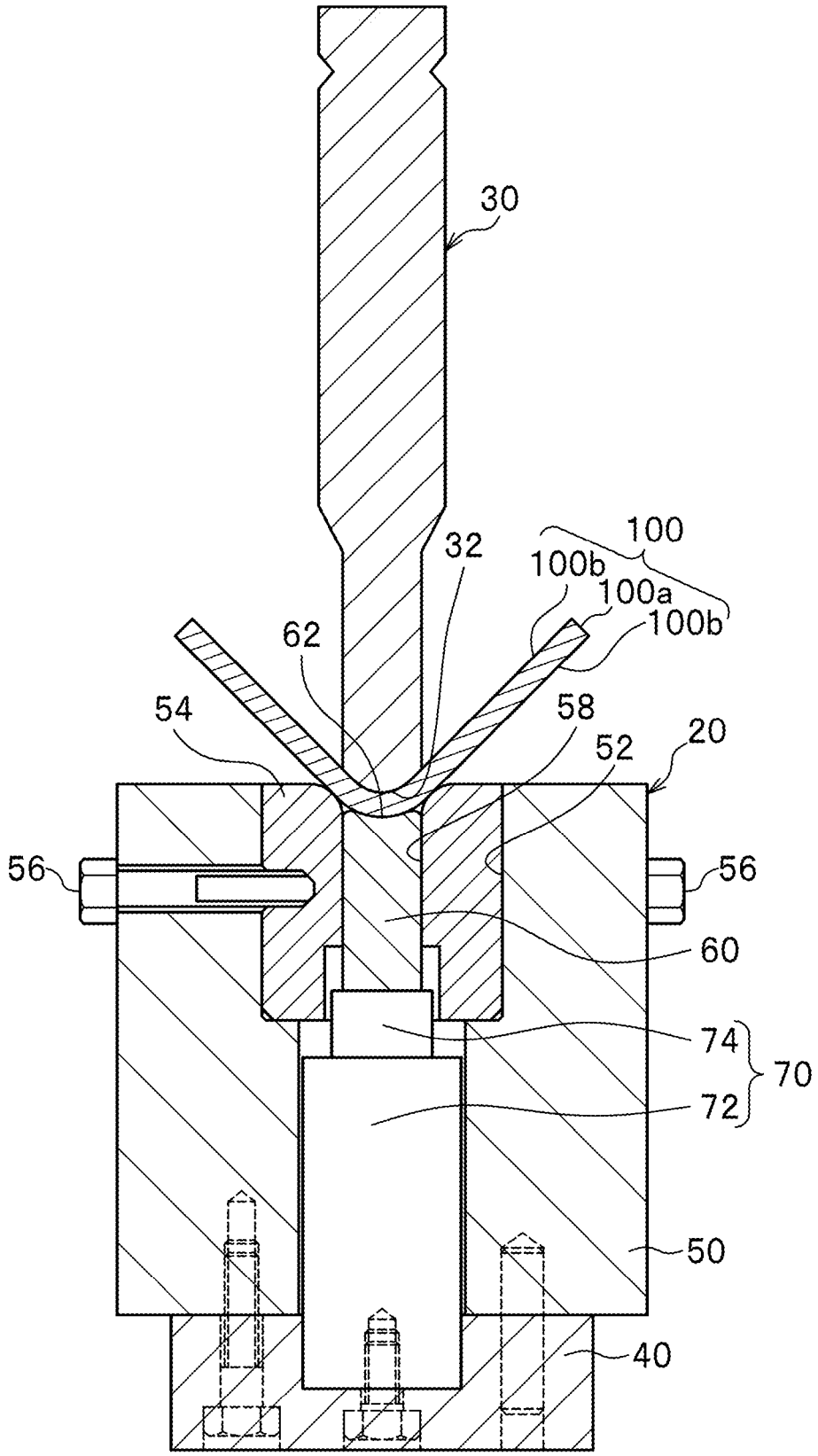
FIG. 4 is a vertical cross-sectional view taken along line IV-IV in FIG. 2, illustrating a bending process using the die set and the working method using such die set according to Embodiment 1.

FIG. 2 is a top view illustrating the lower die 20 of the dies 10. The lower die 20 has a placing part 50 that is fixed to a base part 40, a lower movable part 60, and gas springs 70 as reaction force generating members that support the lower movable part 60 from the bottom. Among them, the placing part 50 has a groove part 52 with a concave shape, formed in a longitudinal direction A. To the groove part 52, fitted is the receiving member 54. The receiving member 54 is fixed to the placing part 50 with a plurality of bolts 56 (see FIG. 4).

The receiving member 54 has a slit part 58 that is formed in the longitudinal direction A. The lower movable part 60 is put in the slit part 58 of the receiving member 54. In the top surface part of the lower movable part 60, formed is an opposing surface 62 with a concave shape. The opposing surface 62 is opposed to the convex surface of the pressing surface 32 of the upper die. The lower movable part 60 is made slidable vertically in the slit part 58.

Figure 3:
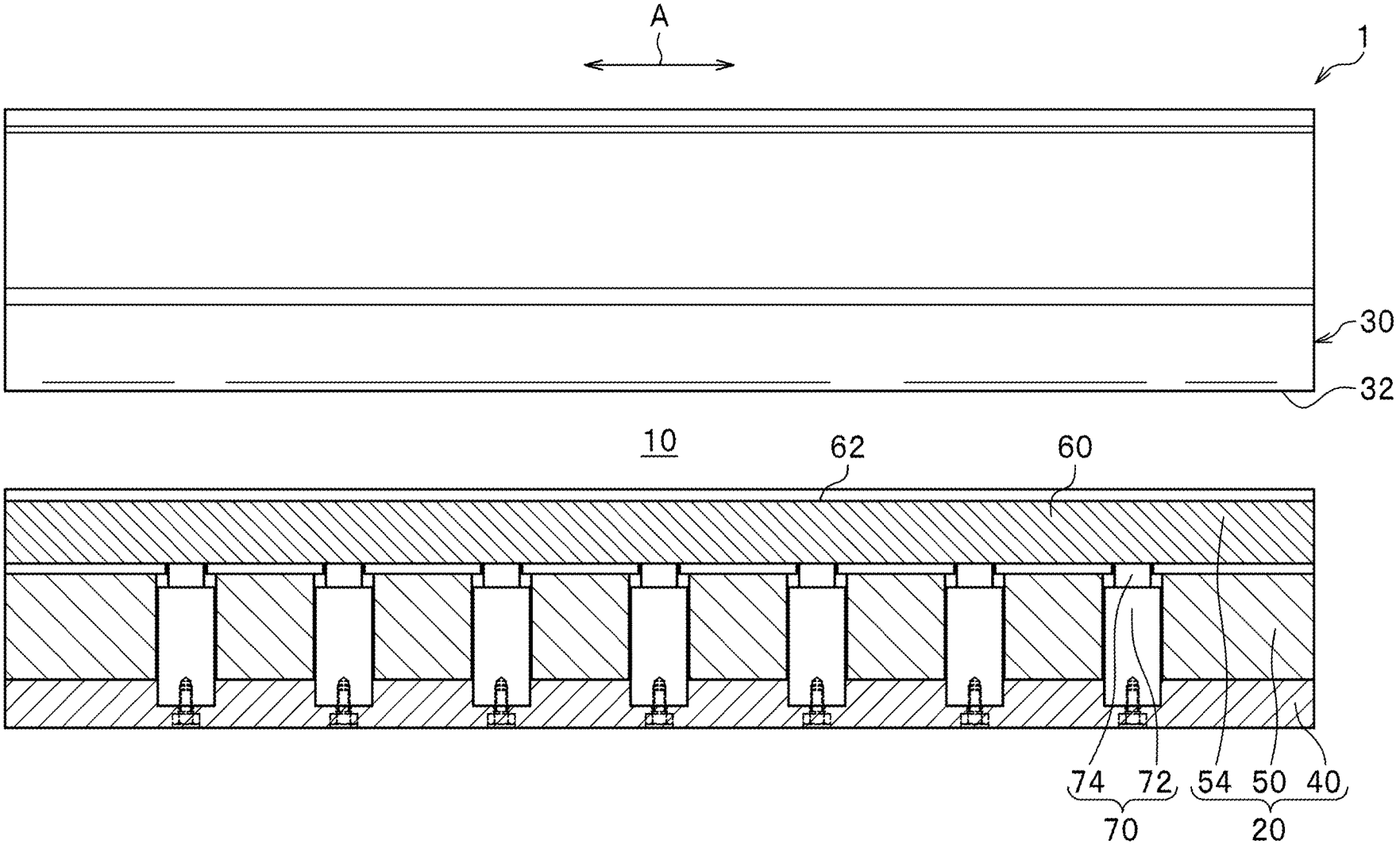
FIG. 3 is a cross-sectional view taken along line in FIG. 2.

As illustrated in FIG. 2 or FIG. 3, the gas springs 70, seven pieces here, are arranged in a row at predetermined intervals, along the longitudinal direction A (the direction the slit part 58 extends) of the lower die 20, just below the slit part 58.

Each gas spring 70 has a cylinder 72 and a piston 74. The piston 74 is made adjustable in reaction force, depending on pressure of a gas filled in the cylinder 72. In Embodiment 1, nitrogen gas is used as a filler gas. The gas is, however, not specifically limited thereto, allowing other gases or mixture of these gases to be used.

Figure 5:
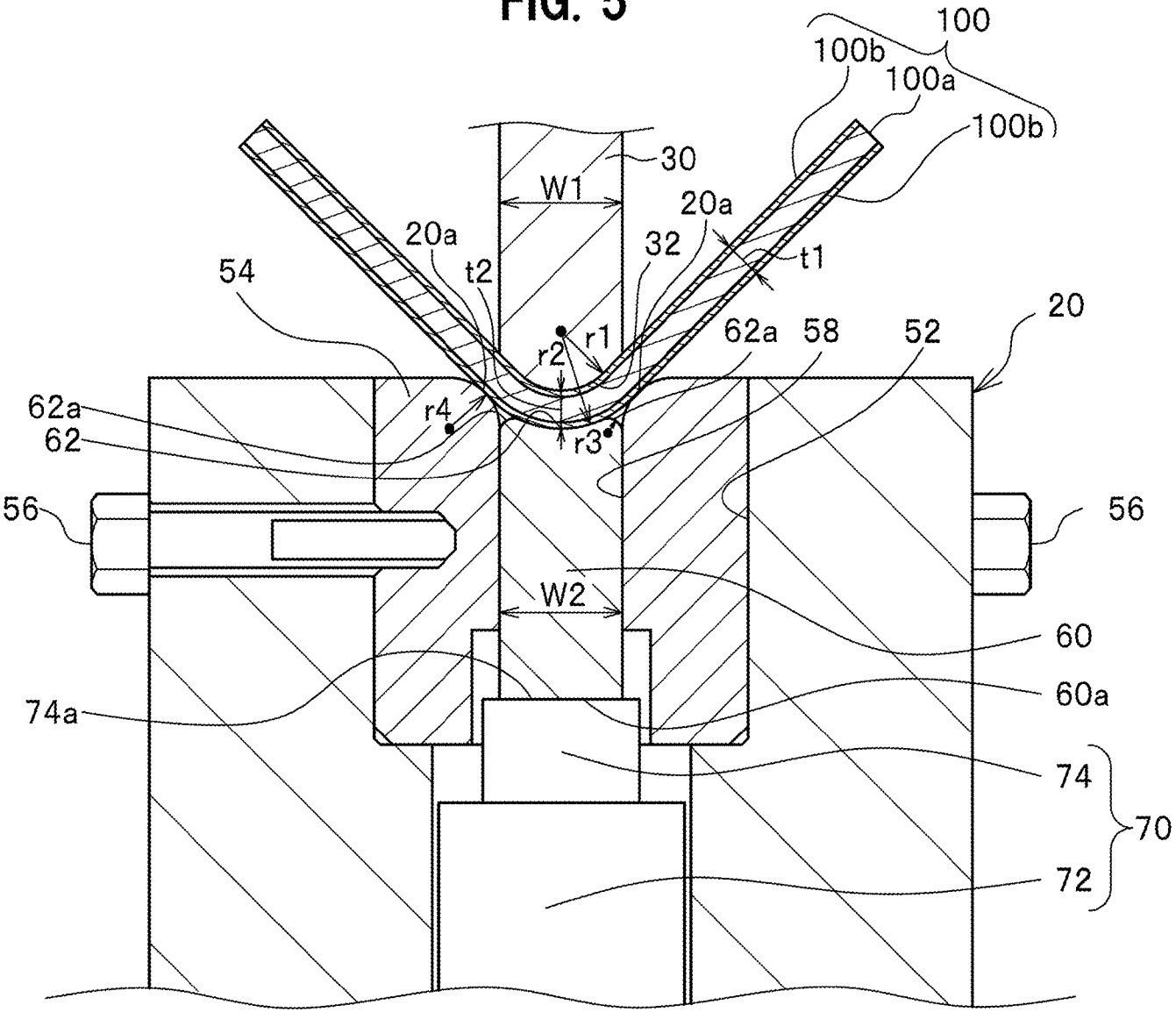
FIG. 5 is a vertical cross-sectional view illustrating an essential part in explanation of dimensional relations.

Now as illustrated in FIG. 5, an upper end surface 74*a* of the piston 74 is brought into contact with a lower surface 60*a* of the lower movable part 60. The gas springs 70 are made so as to elastically support the lower movable part 60 from below.

The opposing surface 62 positioned at the top end of the lower movable part 60 has a concave that extends in the longitudinal direction A. The concave has a cross section curved in arc shaped downwardly. The concave of the opposing surface 62 has radius of curvature r2 which is not smaller than the radius of curvature r1 of the pressing surface 32.

The opposing surface 62 has end parts 62*a*, 62*a* both having a cross section curved in an arc shaped upwardly. Each end part 62*a* is designed to have a radius of curvature r3 smaller than a radius of curvature r4 of the edge parts 20*a*, 20*a* of the receiving member 54 ($r3<r4$). With such design, each space surrounded by three members, namely each end part 62*a* of the lower movable part 60, each edge part 20*a* of the receiving member 54 and the workpiece 100, may be shrunk. This successfully reduces tensile force exerted on the workpiece 100, and can suppress cracking.

In Embodiment 1, thickness dimension t1 of the plate-like workpiece 100 is set larger than difference ($r2-r1$) after subtracting the radius of curvature r1 of the pressing surface 32 from the radius of curvature r2 of the concave of the opposing surface 62 ($t1>(r2-r1)$).

Next, the working method using the dies 10 of Embodiment 1 will be explained, referring to the individual steps illustrated in FIGS. 6A to 6D. Embodiment 1 will explain a process in which the workpiece 100 in the form of long flat sheet is bent nearly at the widthwise center at approximately 90 degrees, using the bending machine 1.

Figure 6A:
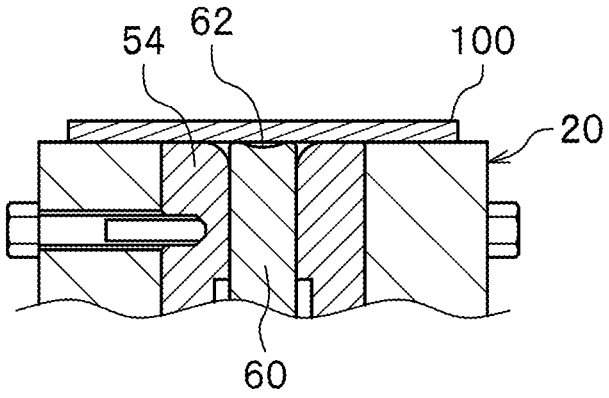
FIG. 6A is a schematic process drawing illustrating a step of setting a workpiece on the lower die, according to the working method using the die set.
Figure 6B:
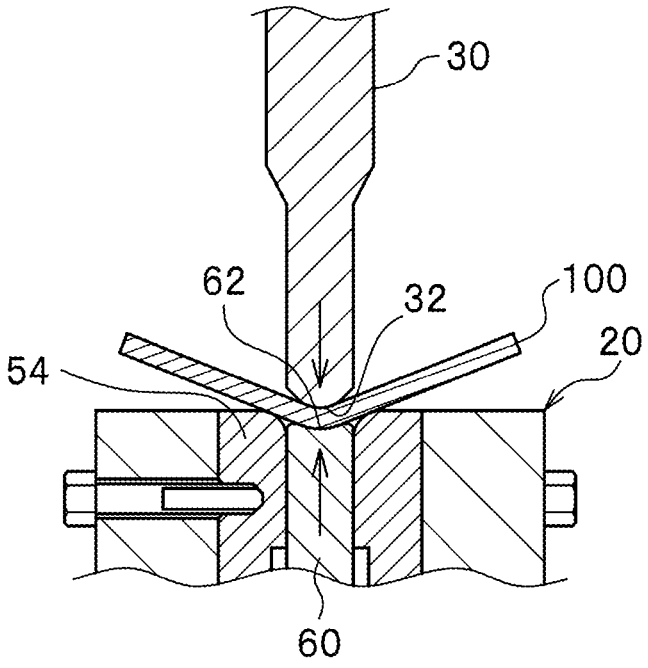
FIG. 6B is a schematic process drawing illustrating a step of pressurizing the workpiece with an upper die.

First, as illustrated in FIG. 6A, the workpiece 100 is placed on the top surface of the lower die 20 to complete setting. In this process, both end parts 62*a*, 62*a* of the lower movable part 60 and the top surface of the receiving member 54 are brought into contact with the lower surface of the workpiece 100. The upper die 30 is now rested at a retracted position, although not illustrated in the drawing. Next, as illustrated in FIG. 6B. the upper die 30 is brought down to press the workpiece 100. The pressing surface 32 of the upper die 30 pressurizes the workpiece 100 from above, and holds the workpiece 100 between itself and the opposing surface 62 of the lower movable part 60. The gas springs 70 move downwards under pressurizing force from the upper die. As the upper die 30 further descends, the lower movable part 60 then descends, and the workpiece 100 starts to deform in the bending process, with the point of origin of bending located approximately at the widthwise center. In particular, the lower movable part 60 moves downwards, while keeping the opposing surface 62 brought into contact with the lower surface of the workpiece 100. The lower surface of the workpiece 100 is brought into contact with the moving opposing surface 62, and with the fixed edge part 20*a*, 20*a* on both sides. Hence, the deformation gradually starts in such a way that the skin part 100*b* on the lower surface side of the workpiece 100 is bent conforming to the curved profile of the opposing surface 62, while suppressing any deformation accompanied by abrupt creation of tension.

Figure 6C:
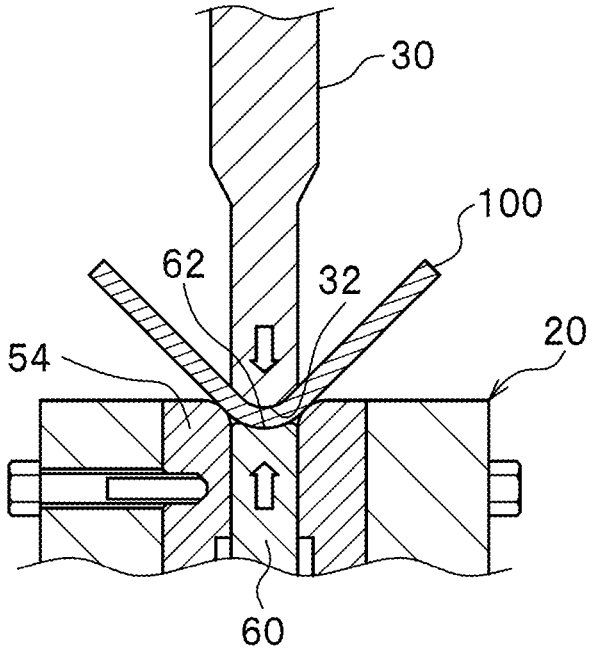
FIG. 6C is a schematic process drawing illustrating a step of bringing the upper die close to the lower die, while the workpiece is urged by the reaction force generating member under reaction force in the direction opposite to the direction of movement of the upper die.

FIG. 6C illustrates a step of further bringing the upper die 30 down to pressurize the workpiece 100. In this step, while the upper die 30 is further brought down, the reaction force from the gas springs 70 is kept applied to the lower movable part 60. Hence, the workpiece 100 is energized in the upward direction which is opposite to the downward moving direction of the upper die 30. The gas springs 70 exert relatively strong initial reaction force as compared with other reaction force mechanisms such as spring, making it possible to tightly hold the workpiece between the upper die and the lower die. As the upper die 30 descends, the upper die 30 approaches the lower die 20. Hence, the workpiece 100 that is held between the opposing surface 62 of the lower die 20 and the pressing surface 32 of the upper die 30 causes bending deformation, conforming to the curved profiles of the opposing surface 62 and the pressing surface 32.

On both sides of the lower movable part 60, the workpiece 100 stays held by the opposing surface 62, the edge parts 20*a*, 20*a*, and the pressing surface 32 of the upper die 30. When the upper die 30 is brought down to a predetermined position, the workpiece 100 is bent at 90 degrees so as to direct the lower surface outwards, with the widthwise center of the workpiece 100, which is in contact with the opposing surface 62, located at the center. Note that the workpiece 100 may alternatively be bent at around the widthwise center at an acute angle smaller than 90 degrees, taking spring back of the workpiece 100 into consideration.

Figure 6D:
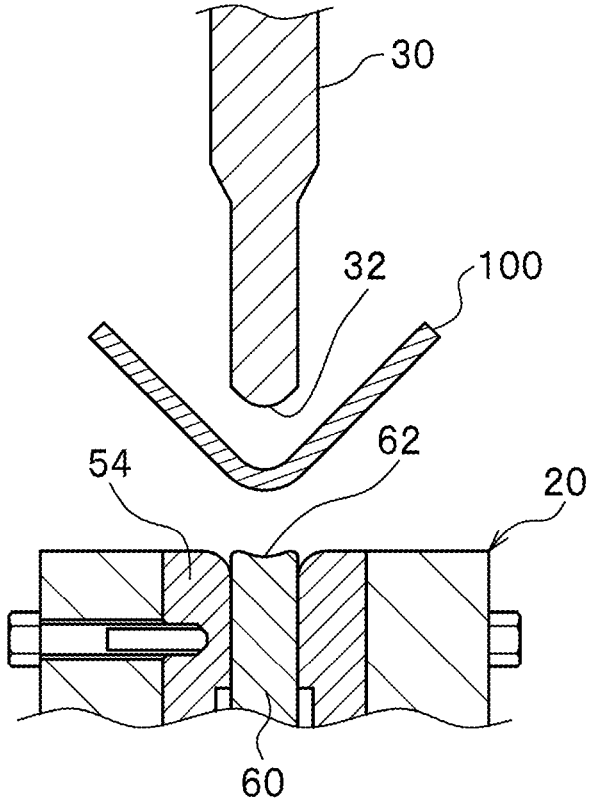
FIG. 6D is a schematic process drawing illustrating a step of taking out the workpiece.

As seen in FIG. 6D, when the upper die 30 moves upward and rests itself in the retracted position, a gap is formed between the lower die 20 and the upper die 30. Pressurizing force of the upper die 30 will no longer be applied to the lower movable part 60 of the lower die 20. The reaction force from the gas springs 70 therefore acts as force that pushes up the workpiece 100 from the base part 40. Hence, by retracting the upper die 30, the bent workpiece 100 will easily be taken out from the bending machine 1.

Next, operations and effects of the dies 10 and a working method using the dies 10 according to Embodiment 1 will be explained. In the dies 10 of Embodiment 1, the lower movable part 60 of the lower die 20 is elastically supported by the gas springs 70 from below. The upper die 30 is moved downwards to pressurize the workpiece 100 under the pressing surface 32. The workpiece 100 is thus held between the pressing surface 32 and the opposing surface 62, and then pressed for bending against the lower die 20 while being kept under compressive force (holding force) in the thickness direction.

In the dies 10, as illustrated in FIG. 6A, the opposing surface 62 of the lower movable part 60 that is elastically supported by the gas springs 70 from below is brought into contact with the lower surface of the workpiece 100, in the vicinity of the top surface part of the lower die 20. Hence as illustrated in FIG. 6B, the workpiece 100 can be held between the pressurizing surface 32 and the opposing surface 62, from an early stage of the bending process, so that the workpiece 100 can be bent under compressive stress applied in the thickness direction. Hence, metal in a portion of the skin part 100*b*, which is diminished due to compression, will migrate towards both outward directions along the lower surface side (outer surface in the direction of bending) of the workpiece 100. Since the metal of the skin part 100*b* migrates so as to compensate the metal in a bent portion of the skin part 100*b* having been diminished due to compression, so that the tension created on the lower surface side may be moderated.

The skin part 100*b* on the top surface side of the workpiece 100 is compressed under the pressing surface 32 having the radius of curvature r1 which is set smaller than the radius of curvature r2 of the opposing surface 62 (see FIG. 5). The workpiece 100 is therefore less likely to cause wrinkling on the top surface side (inner side when viewed in the direction of bending). In this way, the dies 10 and the working method using the dies 10 according to Embodiment 1 can suppress rupture or wrinkling of the workpiece during bending.

As described above, with the bending machine 1 of Embodiment 1, the workpiece 100 is bent while being held, and therefore gradually compressed, between the upper die 30 and the lower die 20 with the aid of reaction force from the gas springs 70. As the bending proceeds in Embodiment 1, the workpiece 100 is compressed in the thickness direction, particularly with the portion, which is in contact with the opposing surface 62 of the lower movable part 60, located at the center. The skin part 100*b* on the lower surface side of the work 100 can therefore migrate together with the material composing the adjacent core part 100*a* in the direction of extension, thus moderating the tension. Hence, the workpiece 100 will have moderated tension in association with deformation in the bending process, and will be suppressed from causing rupture on the lower surface side. The workpiece 100 also will have moderated compressive stress on the top surface side, and will be suppressed from wrinkling.

In short, with the bending machine 1 of Embodiment 1, the workpiece 100 when placed on the lower die 20 and pressurized by the upper die 30 is held making use of reaction force from the lower die 20. The workpiece 100 is kept under compressive stress in the thickness direction, over a period from the point in time the workpiece 100 is pressurized under the upper die 30 up to a point in time the lower movable part 60 reaches the lowest point. This successfully suppresses slippage between the dies 10 and the workpiece 100, and moderates the tension that effects along the side face at around a portion where the opposing surface 62 is brought into contact.

With the workpiece 100 being kept holding, the lower movable part 60 of the lower die 20 is moved downwards in a sliding manner. The origination point of bending therefore moves along the lower surface of the workpiece 100, so that the bending stress created over the workpiece 100 may be prevented from locally concentrating.

More specifically, the origination point of bending of the workpiece 100 in the early stage of bending process appears individually at a point where the pressing surface 32 comes into contact with the top surface of the workpiece 100, and at points where the workpiece 100 comes into contact with the edge parts 20*a*. When the lower movable part 60 moves downwards in a sliding manner with the workpiece 100 being kept holding, the points where the workpiece 100 comes into contact with the edge parts 20*a* will move in a sliding manner, so as to inwardly approach to each other further below the aforementioned points.

When the lower movable part 60 reaches the lowest point, namely a point where the gas springs 70 can no longer be compressed, the stress will be concentrated on the center line of a rounded part, formed by bending, of the workpiece 100. The tension appears on the outer side of the bent workpiece 100. In Embodiment 1, shapes of the pressing surface 32 of the upper die 30, the opposing surface 62 of the lower movable part 60, as well as the edge parts 20*a*, 20*a* located on both sides of the lower die 20 are determined to maximize the area of contact with the workpiece 100. Hence during the bending process, the bent portion of the workpiece 100 may be embraced by the dies 10, to thereby moderate the tension created in the workpiece 100.

Next, a working method using the dies 10 of Embodiment 2, which is a modified example of Embodiment 1, will be explained referring to steps illustrated in FIGS. 7A to 7D. Now in Embodiment 2, explained are the individual steps for bending the workpiece 100 in the form of long flat sheet, nearly at the widthwise center at approximately 90 degrees, using the bending machine 1 constructed in the same way as in Embodiment 1.

Figure 7A:
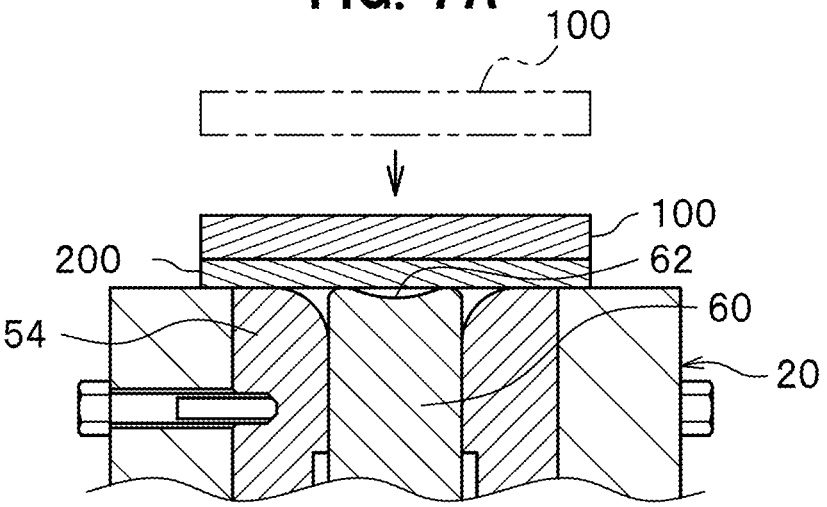
FIG. 7A is a schematic process drawing illustrating a step of setting the workpiece on an underlay sheet placed on the lower die, regarding a die set and a working method using such die set according to Embodiment 2 of the present invention.

First, as illustrated in FIG. 7A, an underlay sheet 200 as an auxiliary member is placed on the top surface part of the lower die 20. The underlay sheet 200 is composed of an aluminum alloy that excels in ductility. Thickness-wise dimension of the underlay sheet 200 is set equivalent to, or larger than that of the workpiece 100. However, not only such dimensional setting but also the thickness-wise dimension of the underlay sheet 200, set smaller than that of the workpiece 100, is acceptable. Then on the underlay sheet 200, the workpiece 100 is placed. The upper die 30 that stays at the retracted position is not illustrated.

Figure 7B:
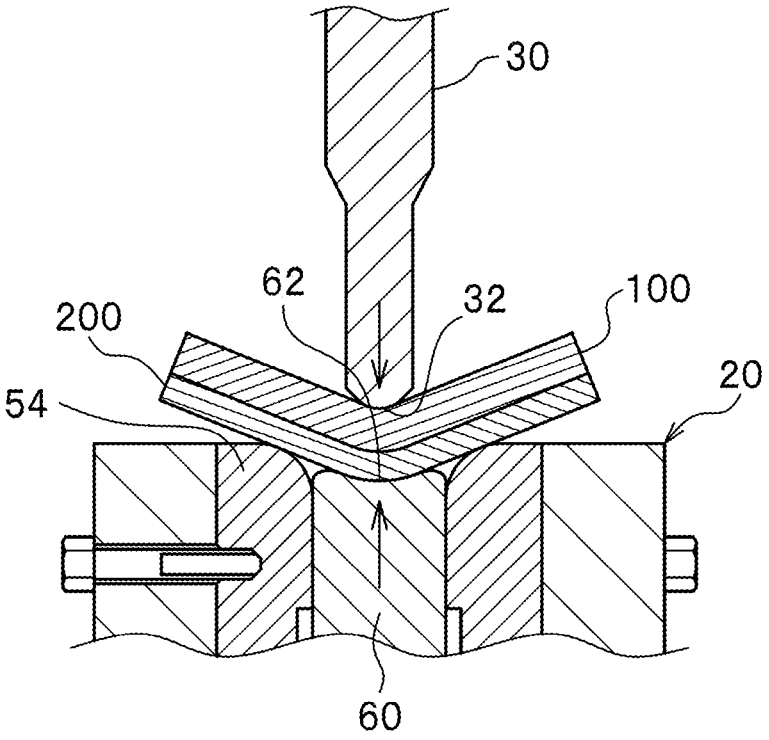
FIG. 7B is a schematic process drawing illustrating a step of pressing the workpiece with the upper die.

Next, as illustrated in FIG. 7B, the upper die 30 is brought down to pressurize the workpiece 100. The pressing surface 32 of the upper die 30 pressurizes the workpiece 100 from above, and holds the workpiece 100 and the underlay sheet 200 between itself and the opposing surface 62 of the lower movable part 60. The workpiece 100 is now clamped by the upper die 30 and the lower movable part 60, so as not to move outwards. At a point where the angle of bending of the workpiece 100 becomes approximately 130°, the workpiece 100 starts to be bent, with the rounded parts of the receiving member 54 served as fulcrums. The pistons 74 move downwards under pressurizing force from the upper die. As the upper die 30 further descends, the lower movable part 60 then descends, and workpiece 100 starts to deform in the bending process, with the point of origin of bending located approximately at the widthwise center. In particular, in the early stage of bending deformation of the workpiece 100, the lower surface of the underlay sheet 200 is supported from below, while being kept in contact with the opposing surface 62 and the edge parts 20*a*, 20*a* that are fixed on both sides. Hence, the deformation gradually starts at the lower surface side of the under lay sheet 200 conforming to the curved profile of the opposing surface 62, while suppressing any deformation possibly causing abrupt change of tension over the surface of the workpiece 100. In usual bending process, the outer side when viewed in the thickness direction of the workpiece 100 comes under tensile force, the center portion stays neutral, and the inner side comes under compression pressure. In the present invention, while the underlay sheet 200 stretches, the workpiece 100 comes under compression pressure, successfully achieving a less-crackable effect.

Figure 7C:
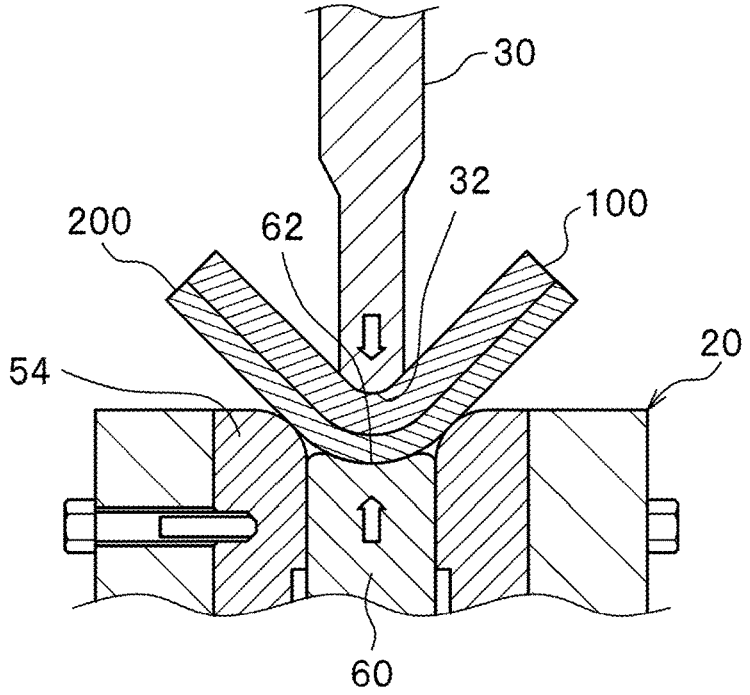
FIG. 7C is a schematic process drawing illustrating a step of bringing the upper die close to the lower die, while the workpiece is urged by the reaction force generating member under reaction force in the direction opposite to the direction of movement of the upper die.

FIG. 7C illustrates a step of further bringing the upper die 30 downwards to pressurize the workpiece 100. In this step, when the upper die 30 descends, the upper die 30 is brought closer to the lower die 20, with the workpiece 100 and the underlay sheet 200 being urged upwards by the gas springs 70 under the reaction force. Hence, the workpiece 100 and the underlay sheet 200 are bent together, while being compressed between the lower die 20 and the upper die 30. Note that the workpiece 100 and the underlay sheet 200 may alternatively be bent beyond 90 degrees at around the widthwise center, taking spring back of the workpiece 100 and the underlay sheet 200 into consideration.

Figure 7D:
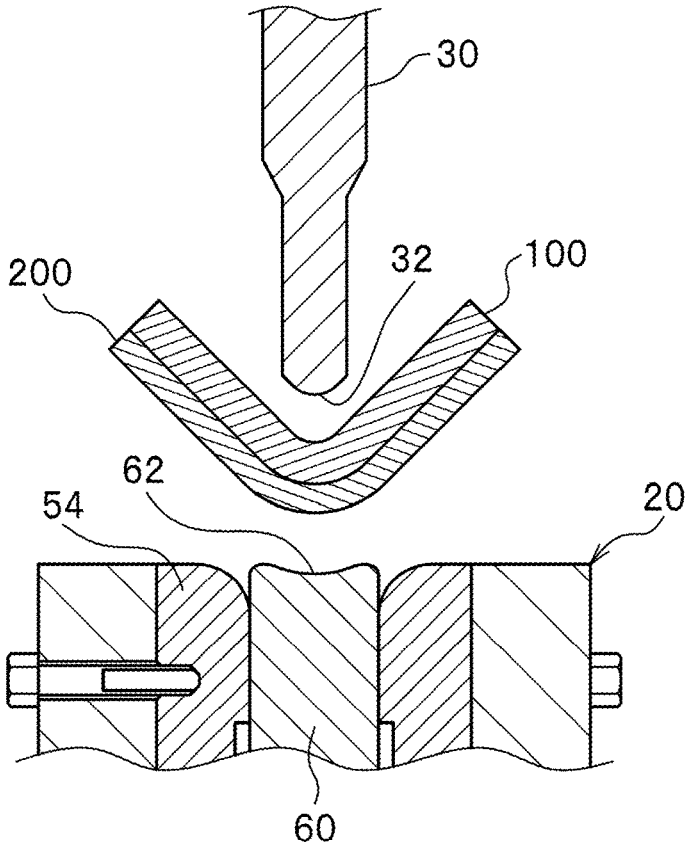
FIG. 7D is a schematic process drawing illustrating a step of taking out the workpiece.
Figure 8:
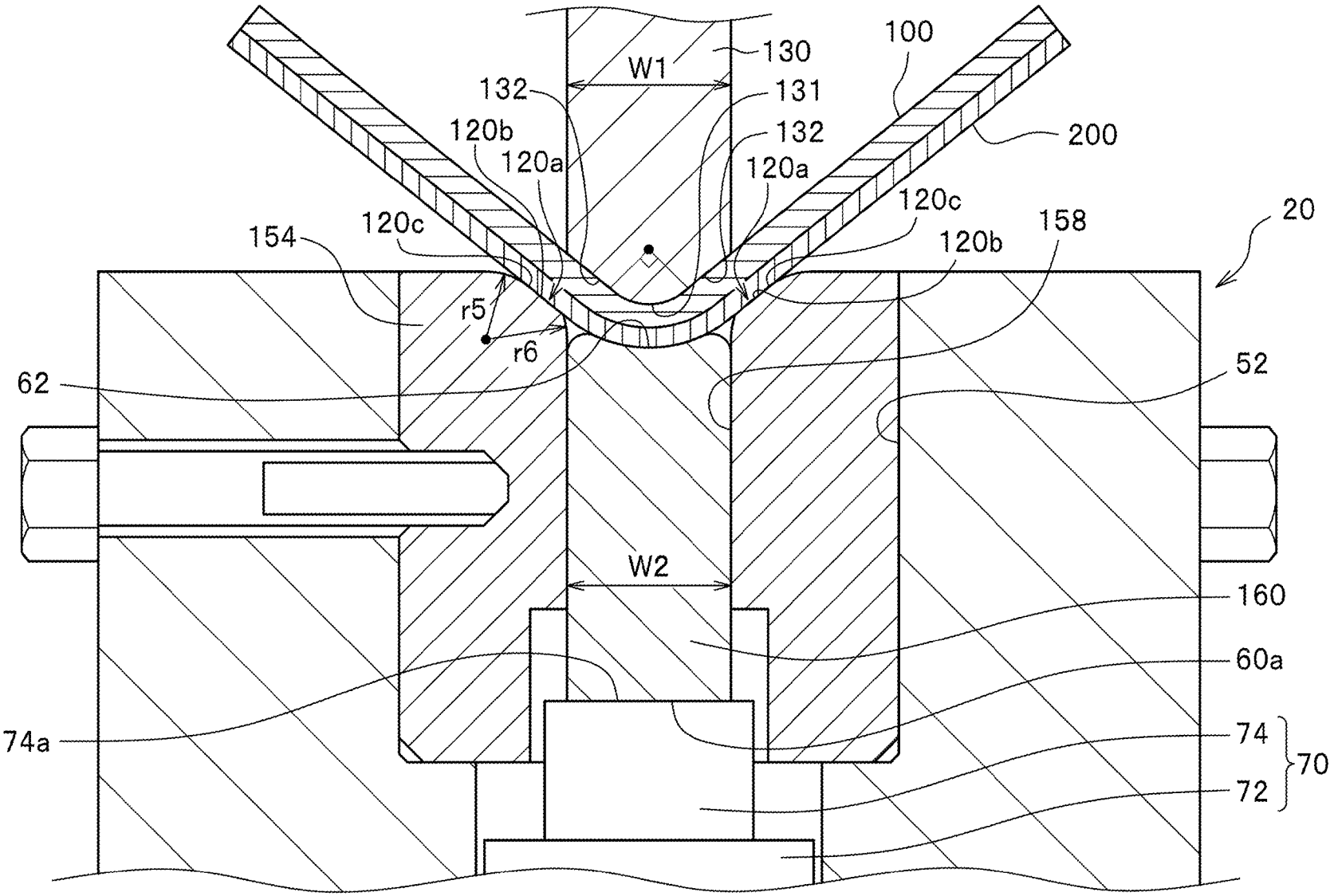
FIG. 8 is a vertical cross-sectional view illustrating an essential part in explanation of dimensional relations in Embodiment 3.

Then as illustrated in FIG. 7D, when the upper die 30 moves upward and rests itself at the retracted position, a gap is formed between the lower die 20 and the upper die 30. Pressurizing force of the upper die 30 will no longer be applied to the lower movable part 60 of the lower die 20. The reaction force from the gas springs 70 therefore acts on the workpiece 100 and the underlay sheet 200 as lifting force. Hence, by retracting the upper die 30, the bent workpiece 100 and the underlay sheet 200 will easily be taken out from the bending machine 1.

As has been described above, the dies 10 of Embodiment 2 not only demonstrate operations and effects of Embodiment 1, but also enable bending process of the workpiece 100 together with the underlay sheet 200, while compressed between the lower die 20 and the upper die 30. The workpiece 100 in Embodiment 2 is supported from below, by the underlay sheet 200 that is brought into contact evenly within the in-plane direction, from the early stage of deformation. Hence, the workpiece 100 is bent while being held between the upper die 30 and the underlay sheet 200 with the aid of reaction force from the gas springs 70. Now the workpiece 100 is more strongly held by the underlay sheet 200, and may be bent while being kept under compression pressure, but not under tensile force. Moreover, the tension created on the lower surface side of the workpiece 100 is distributed in plane, rather than being concentrated at one point. Hence, the workpiece 100 may effectively be suppressed from causing rupture or wrinkling on the top surface side.

Other structures, operations and effects are same as those in Embodiment 1, and therefore will not be explained repetitively.

FIG. 8 and FIGS. 9A to 9D are presented to explain the dies and a working method using such dies, according to Embodiment 3 of the present invention. Note that all parts that are identical or equivalent to those in Embodiments 1 and 2 will be given same reference signs, and therefore will not be explained repetitively. First, a structure of Embodiment 3 will be explained, placing a major focus on differences from those in Embodiments 1 and 2.

Each edge part 120*a* of a receiving member 154 has a flat part 120*b*, as a flat surface inclined to a horizontal plane, in at least a part of the rounded part. The edge part 120*b* has a flat surface that will be brought into contact with the workpiece 100, and is formed over the entire length in the longitudinal direction A of the receiving member 154 (see FIG. 1), so as to be inclined approximately 45 degrees from the horizontal plane. Rounded parts juxtaposed respectively at the upper and lower ends of each flat part of the edge part 120*a* have convex surfaces respectively having radii of curvatures r5 and r6, which are nearly equal to the radius of curvature r4 of the edge part 20*a* of the receiving member 54 in Embodiment 1. That is, the rounded parts juxtaposed respectively to the upper and lower ends of each flat part 120*b* have curved surfaces with nearly equal arc lengths. The radius of curvature r5 and the radius of curvature r6 may be different from each other, or the rounded parts may be composed of curved surfaces with different arc lengths, without being specifically limited to the examples described above.

In other words, symmetry about the flat parts 120*b* is not essential, allowing asymmetry instead.

In Embodiment 3, a pressing surface 132 of an upper die 130 has a convex surface formed at the lower end part, and a pair of flat surfaces juxtaposed with the curved face on the left and right sides. Angle of inclination of the flat faces of the pressing surface 132 of the upper die 130 was set equal to that of the opposing flat parts 120*b*. In other words, the left and right flat surfaces of the pressing surface 132 are parallel to the respective opposing flat surfaces 120*b* (flat surfaces of the edge part 120*a* of the receiving member 154).

Figure 9A:
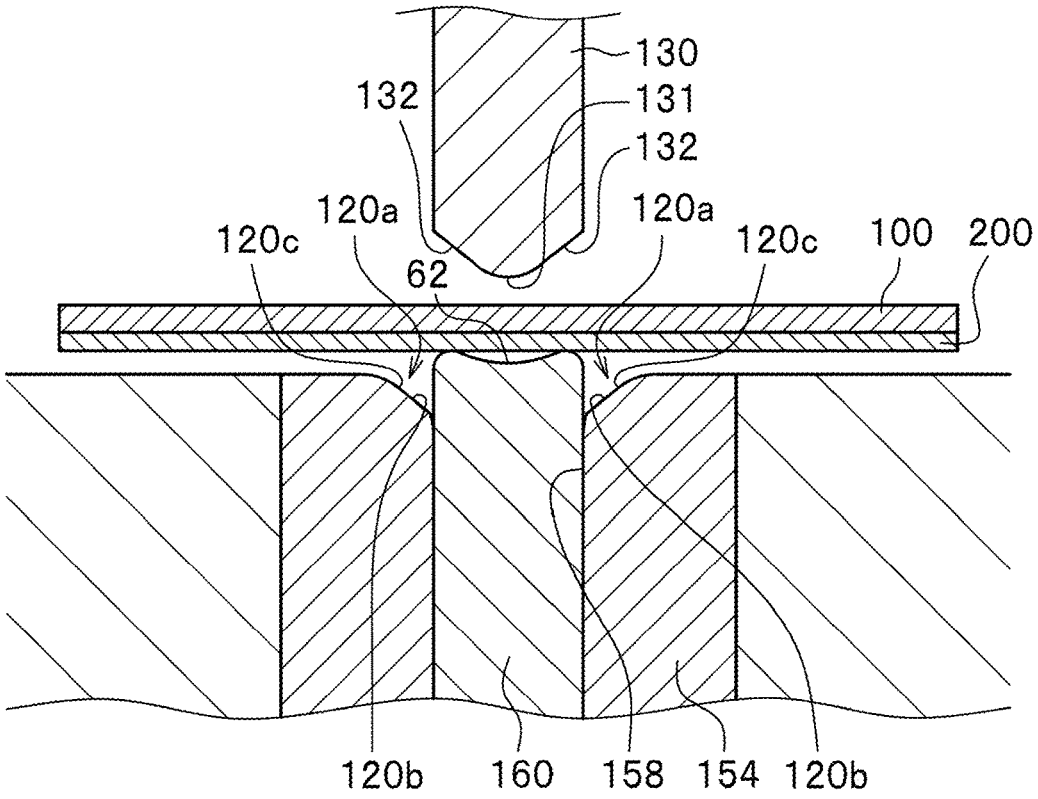
FIG. 9A is a schematic process drawing illustrating a step of setting the workpiece on an underlay sheet placed on the lower die, regarding a die set and a working method using such die set according to Embodiment 3 of the present invention.

Next, operations and effects of the dies and the working method using such dies according to Embodiment 3 will be explained referring to schematic process drawings illustrated in FIGS. 9A to 9D. With the dies of Embodiment 3, first, the workpiece 100 is placed on the lower die 20 as illustrated in FIG. 9A. On the lower side of the workpiece 100, preliminarily stacked is the underlay sheet 200. The workpiece 100 is supported from below together with the underlay sheet 200, by the lower movable part 160.

Figure 9B:
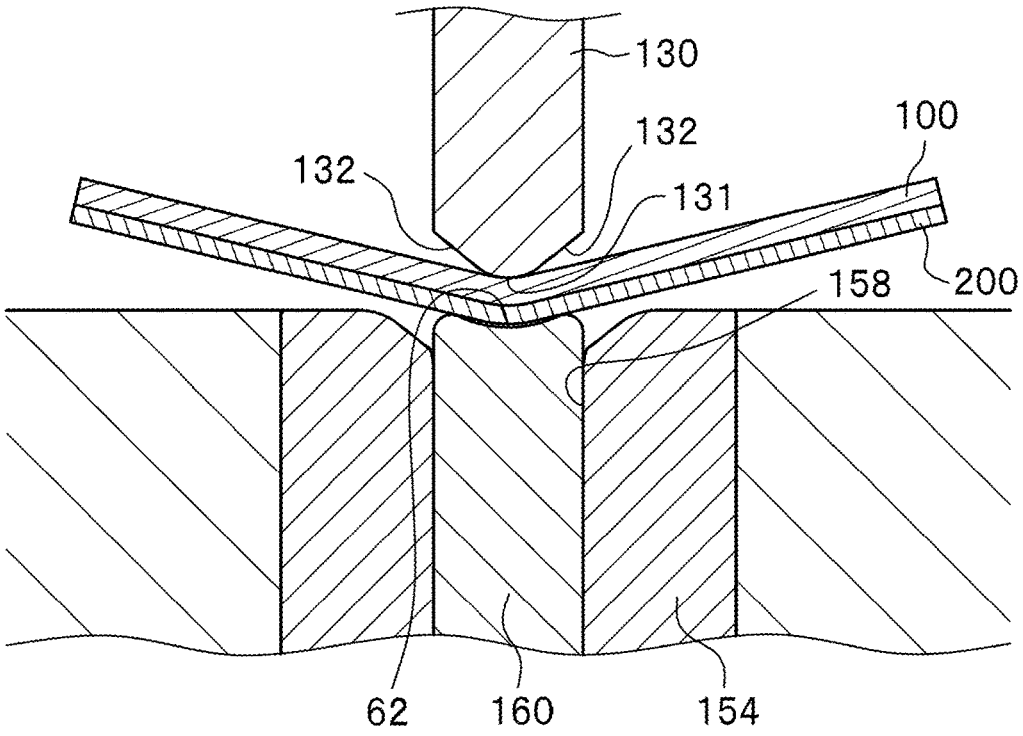
FIG. 9B is a schematic process drawing illustrating a step of pressing the workpiece with the upper die.

As illustrated in FIG. 9B, the upper die 130 is brought down to hold the workpiece 100 between a projected part 131 of the upper die 130, and the opposing surface 62 of the lower movable part 160, thus pressurizing the workpiece 100 both from the above and below. The opposing surface 62 of the lower movable part 160 has a curved surface that is convex downwards. Hence, the workpiece 100 held between the upper die 130 and the lower movable part 160 causes primary deformation conforming to the opposing surface 62. The workpiece 100 when primarily deformed (the workpiece 100 is not yet brought into contact with receiving member 154) has an angle of approximately 14° away from the horizontal plane. With the angle of this level, unnecessary deformation due to abrupt tension may be suppressed.

Figure 9C:
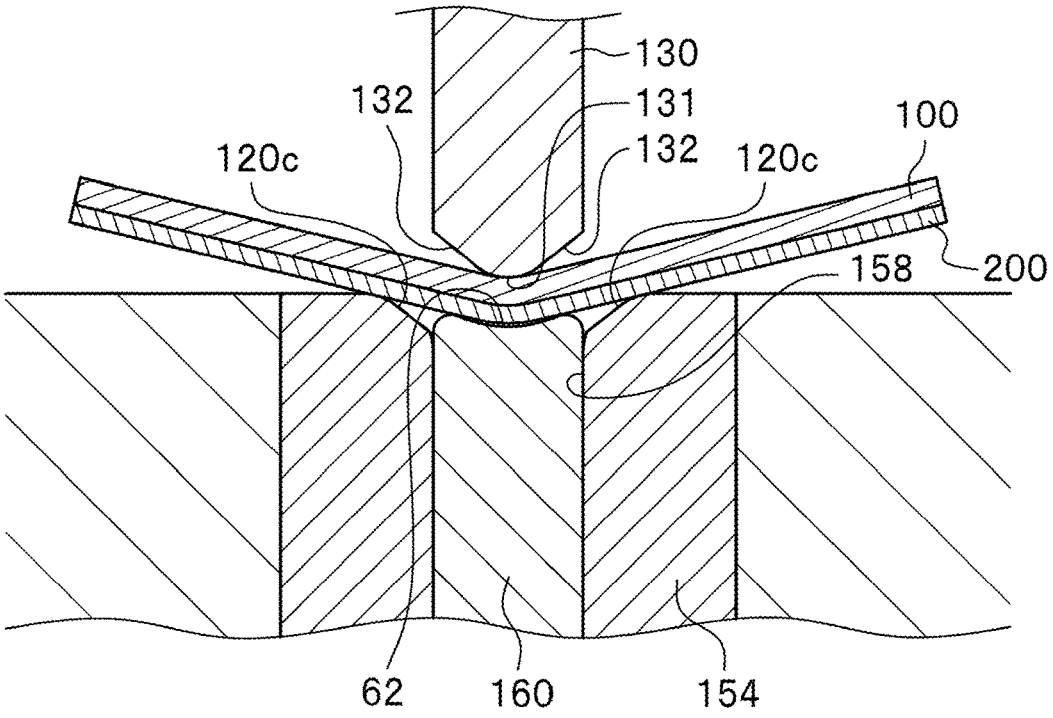
FIG. 9C is a schematic process drawing illustrating a step of bringing the upper die close to the lower die, while applying force in the direction opposite to the direction of movement of the upper die, using the reaction force from reaction force generating members.

As illustrated in FIG. 9C, as the upper die 130 further descends against the pressurizing force from the lower movable part 160, also the lower movable part 160 descends, where the underlay sheet 200 comes into line contact with a part of curved surfaces (radius of curvature r5) on the outer side of inflection parts 120*c*, 120*c*. The workpiece 100 then starts secondary deformation. The underlay sheet 200 placed under the workpiece 100 deforms while being kept in slide contact with the inflection parts 120*c*, 120*c*. The workpiece 100 that deforms together with the underlay sheet 200 is less likely to crack, since the underlay sheet 200 is disposed on the outer side where tensile force strongly applies. While keeping the workpiece 100 and the underlay sheet 200 held between the opposing surface 62 of the lower movable part 160 and the projected part 131 of the upper die 130, the lower movable part 160 and the upper die 130 are allowed to descend downwards, where the lower surface of the workpiece 100 comes into contact with the edge parts 120*a*, 120*a*. When the lower movable part 160 and the upper die 130 are further brought down, the workpiece 100 and the underlay sheet 200 gradually deform conforming to the curved profile of the opposing surface 62 and the profile of the edge parts 120*a* (secondary deformation).

Figure 9D:
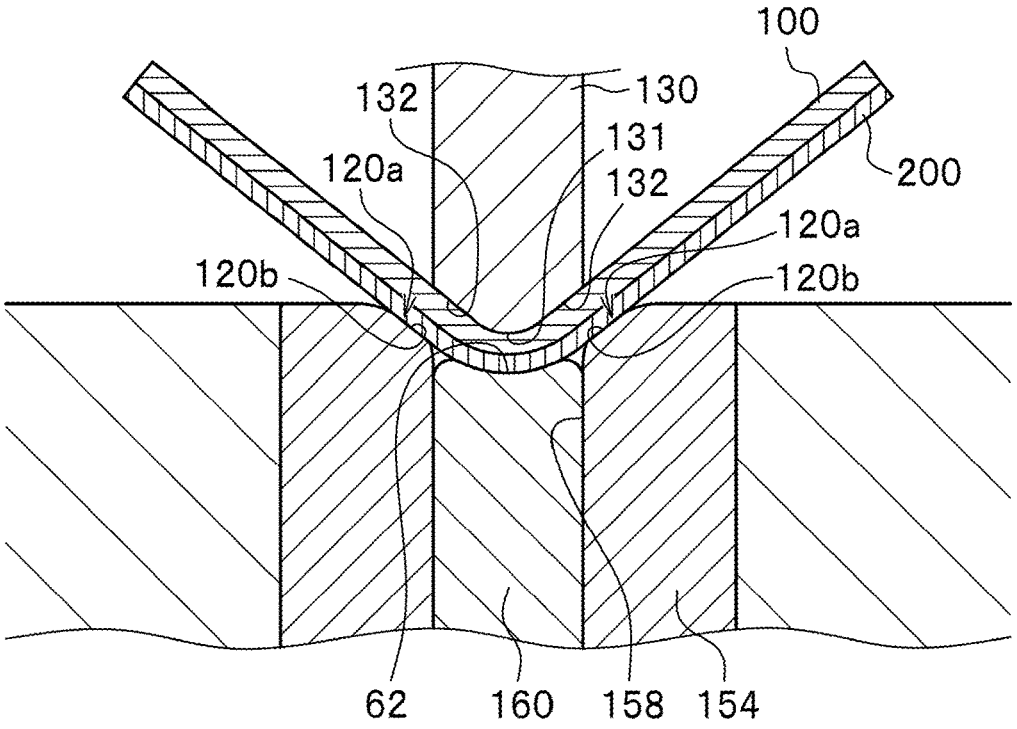
FIG. 9D is a schematic process drawing illustrating a step of taking out the workpiece.

As illustrated in FIG. 9D, as the secondary deformation proceeds, the workpiece 100 is bent to a predetermined angle, between the pressing surface 132 of the upper die 130 and the flat parts 120*b* of the receiving member 154. The pressing surface 132 and the flat parts 120*b* are arranged in parallel. The workpiece 100 is therefore suppressed from deforming between the pressing surface 132 and the flat parts 120*b*.

As described above, in Embodiment 3, the pressing surface 132 of the upper die 130, which is positioned on both sides of the projected part 131, is composed of flat surfaces arranged in parallel to the flat parts 120*b*. Hence, with the workpiece 100 held from both sides in the in-plane direction and the out-of-plane direction, it becomes easier to apply the pressure for bending exactly at the center part. In this way, dimensional accuracy of the finished workpiece 100 may further be improved. Other structures, operations and effects are identical or equivalent to those in Embodiments 1 and 2, and therefore will not be explained repetitively.

As explained above, the dies 10 for bending the sheet-like workpiece 100 has the lower die 20 on which the workpiece 100 is placed, the upper die 30 with the pressing surface 32 that pressurizes the workpiece 100 towards the lower die 20, the lower movable part 60 provided to the lower die 20 and is slidable in the direction same as the direction the upper die 30 moves, and the gas springs 70 that elastically support the lower movable part 60 from below. The pressing surface 32 of the upper die 30 then comes into contact with the top surface of the workpiece 100, and pressurizes the workpiece 100 towards the lower die 20. While the lower movable part 60 elastically supported from below by the gas springs 70 allows its opposing surface 62 to come into contact with the lower surface of the workpiece 100, so as to energize the workpiece 100 upwards, oppositely to the downward direction the upper die 30 moves, the upper die 30 is brought closer to the lower die 20.

In this way, the workpiece 100 is compressed in the thickness direction, and can moderate tension created on the lower surface side that resides on the outer surface when viewed in the direction of bending. In addition, the compressive force may be suppressed from generating on the top surface side, which resides on the inner surface when viewed in the direction of bending. Hence, the workpiece 100 may effectively be suppressed from causing rupture or wrinkling, during the bending process.

The reaction force generating member in this Embodiment is composed of the gas springs 70. Hence, as the length of a piston 74 outside of a cylinder 72 becomes shorter by compression, the reaction force created by a gas inside a cylinder 72 increases, making it possible to increase the reaction force to be applied by the lower movable part 60 to the workpiece 100. Hence, as the lower movable part 60 of the lower die 20 moves downwards in a sliding manner, the upward reaction force of the gas springs 70 grows, so that as the upper die 30 is pressed more and more against the workpiece 100, the holding force that restrains the workpiece 100 in the vertical direction (thickness direction) may be enhanced gradually. As a consequence, the workpiece 100 may be held by a level of holding force enough for avoiding slippage between the workpiece 100 and the dies 10, during the lower movable part 60 moves downwards in a sliding manner.

The gas springs 70 are less likely to decline in the reaction force, even after compressed a large number of times in repetitive bending process using the dies 10. What is better, the gas springs 70 are easy to install, and can save the running cost. The reaction force created by the gas springs 70 enables a stable bending process which is less likely to cause variation. Hence, use of the gas springs 70 can facilitate operations regarding overall setting of the bending machine 1.

The gas springs 70, which are seven pieces in this Embodiment, are arranged along the longitudinal direction A of the lower die 20. This enables creation of the reaction force uniformly over the longitudinal direction A even if the workpiece 100 is long, and enables bending equally at every point in the longitudinal direction A. By arranging the plurality of gas springs 70 along the longitudinal direction A of the lower die 20, it now becomes possible to construct the dies 10 with a length suited to the longitudinal dimension of the workpiece 100.

Each gas spring 70 is also constructed so that the reaction force from the piston 74 is adjustable by changing pressure of the filler gas in the cylinder 72. Hence, by appropriately determining the reaction force corresponding to size or strength of the workpiece 100, pressurizing force of the upper die 30 or the like, the reaction force enough to resist the bending stress necessary for the bending process is obtained. A variety of workpieces 100 may therefore be bent without causing rupture or wrinkling. For an exemplary case of bending a metal-based composite material composed of aluminum and ceramic, in the form of the sheet-like workpiece 100 illustrated in FIG. 5 with a thickness-wise dimension t1 of 3.2 mm, required is a bending stress of at least 13 MPa or larger. Hence, total amount of force of the pressing force form upper die 30 and the reaction force from the lower die 20 needs to be 13 MPa or larger in total.

Moreover, the pressing surface 32 of the upper die 30 has the convex surface, meanwhile the opposing surface 62 of the lower movable part 60 opposed to the pressing surface 32 has the concave with an arcuate cross section, formed so as to extend in the longitudinal direction A. As illustrated in FIG. 5, the curvature radius r2 of the concave of the opposing surface 62 is set larger than the curvature radius r1 of the pressing surface 32 ($r2>r1$). Hence, when the workpiece 100 is compressed between the pressing surface 32 and the opposing surface 62, with increased contact areas of the workpiece 100 with the pressing surface 32 and with the opposing surface 62, the inner and outer surfaces may be designed to have desired radii of curvature and shapes.

Also as illustrated in FIG. 5, both end parts 62*a*, 62*a* of the opposing surface 62 are designed to individually have the radius of curvature r3 smaller than the radius of curvature r4 of the adjacent edge part 20*a*, 20*a* of the lower die 20 ($r3<r4$). This successfully shrinks each space formed while being surrounded by three members namely each end part 62*a* of the lower movable part 60, each edge part 20*a* and the workpiece 100, and can reduce the tension that is possibly accumulated in this space. Hence the workpiece 100 can be embraced, while suitably suppressing slippage of the workpiece 100.

According to the working method using the dies 10 of the Embodiment, the workpiece 100 may be suppressed from causing rupture or wrinkling in the bending process.

In the working method of Embodiment 2, the underlay sheet 200 made of metal is placed on the top surface of the lower die 20, as an additional matter over the working method of Embodiment 1, the workpiece 100 is then placed on the underlay sheet 200, and the upper die 30 is brought down to start the bending process by pressing. In particular, the bending stress exerted on the workpiece 100 becomes maximum when the lower movable part 60 reaches the lowest point. At this point in time, the tension created on the lower surface (outer surface when viewed in the direction of bending) of the workpiece 100 becomes maximum. A region where the tension is created resides over the outer surface of the workpiece 100. Hence, by disposing the underlay sheet 200 on the outer side of the workpiece 100, the region where the tension is created may be shifted to the part of the underlay sheet 200. The workpiece 100 will now be further suppressed from causing rupture or wrinkling.

The present invention is not limited to the aforementioned Embodiments, allowing instead various modifications to be made. The aforementioned Embodiments are merely illustrative ones intended for easy understanding, and are not limited to those having all of the structures explained above. In addition, a part of the structure of a certain Embodiment may be replaced with the structure of other Embodiment(s), or the structure of a certain Embodiment may be combined with the structure of other Embodiment(s). Still alternatively, deletion of a part of structure of each Embodiment, or addition or replacement of other structure are acceptable. Possible modifications to be made on the aforementioned Embodiment are as follows.

The dies and the working method using the dies of the aforementioned Embodiments employ the gas springs 70 as the reaction force generating member. The reaction force generating member is, however, not specifically limited thereto, and may be any member with other structure capable of generating the reaction force, such as those composed of other mechanism like a hydraulic cylinder or metal spring, or those composed of soft and elastic materials including urethane and other synthetic resin foam, or rubber member. In other words, preferable are those supporting the lower movable part 60 from below, and particularly those capable of increasing the reaction force as they are compressed. The reaction force generating member is not specifically limited in terms of shape, quantity and material, so long as it can generate the reaction force in this way.

In Embodiments, seven gas springs 70 are arranged along the longitudinal direction A of the lower die 20 as illustrated in FIG. 3. The quantity is, however, not specifically limited thereto, instead one, or two or more gas springs 70 may be used. Also the arrangement is not limited to the in-line arrangement, but may be freely selectable from multiple-line arrangement, alternate arrangement and so forth.

Furthermore, in this Embodiment, the radius of curvature r3 of both end parts 62*a*, 62*a* of the opposing surface 62 is set smaller than the radius of curvature r4 of the opposing edge parts 20*a*, 20*a* of the slit part 58 of the lower die 20 (r3<r4) as illustrated in FIG. 5, forming a small space surrounded by three members, namely each end part 62*a* of the lower movable part 60, each edge part 20*a* and the workpiece 100. However, without being specifically limited thereto, the shapes of the end part 62*a* and the edge part 20*a* may alternatively be determined so as to further shrink or eliminate the spaces.

In Embodiment 2, employed is the underlay sheet 200 with the thickness-wise dimension which is set equivalent to or larger than that of the workpiece 100. However, without being specifically limited thereto, the thickness-wise dimension smaller than that of the workpiece 100 may be employable, or may be omissible. Furthermore, the shape, quantity and material of the underlay sheet 200 are not specifically limited, and also the number of sheets interposed between the workpiece 100 and the lower die 20 is not specifically limited.

Moreover, while the underlay sheet 200 is stacked on the workpiece 100 in an independent step in Embodiment 2, the process is not limited thereto, allowing instead that the workpiece 100 is preliminarily stacked on the underlay sheet 200, and the underlay sheet 200 and the workpiece 100 are placed at the same time on the top surface part of the lower die 20.

REFERENCE SIGNS LIST

1 die set
10 dies
20 lower die
20*a* edge part
30 upper die
32 pressing surface
40 base part
50 placing part
60 lower movable part
62 opposing face
62*a* end part
70 gas spring (reaction force generating member)
100 workpiece
200 underlay sheet (auxiliary member)

What is claimed is:

1. A die set used for bending a metal plate workpiece, the die set comprising:

a lower die configured to receive the metal plate workpiece; and an upper die having a pressing surface configured to press the metal plate workpiece against the lower die, the lower die including:

a lower movable part being slidable in a same direction as a moving direction of the upper die, the lower movable part having a first end and a second end, wherein the first end and the second end extend in a longitudinal direction of the lower die and are opposite to each other in a transverse direction which is transverse to the moving direction and the longitudinal direction;

a reaction force generating member elastically supporting the lower movable part from below; and at least one receiving member positioned at each of the first end and the second end of the lower movable part, wherein the pressing surface of the upper die has a curved convex surface, the lower movable part has an opposing surface which is opposite to the pressing surface and is curved from the first end to the second end of the lower movable part, the opposing surface being defined by a complex curve defined by, in sequence, a first convex end part at the first end, a concave portion curvedly extending from the first convex end part, and a second convex end part at the second end extending from the concave portion, the concave portion has a cross section curved in an arc shape in the transverse direction, and a radius of curvature of the concave portion is equal to or larger than a radius of curvature of the curved convex surface of the pressing surface.

2. The die set as claimed in claim 1, wherein the reaction force generating member includes a gas spring.

3. The die set as claimed in claim 1, wherein the reaction force generating member comprises a plurality of reaction force generating members arranged in a longitudinal direction of the lower die.

4. The die set as claimed in claim 2, wherein the reaction force generating member is capable of controlling the strength of reaction force.

5. The die set as claimed in claim 1, wherein the at least one receiving member includes a slit part in which the lower movable part is positioned and the at least one receiving member has an edge part on the slit part having a curved convex shape, and each radius of curvature of the end parts of the opposing surface is smaller than each radius of curvature of the edge parts of the slit part.

6. The die set as claimed in claim 1, wherein an edge part of the at least one receiving member has a convex surface.

7. The die set as claimed in claim 1, wherein an edge part of the at least one receiving member has a flat surface inclined to a horizontal plane and a convex surface adjacent to the flat surface.

8. The die set as claimed in claim 7, wherein the pressing surface of the upper die has a flat surface opposing to the flat surface of the at least one receiving member, and the flat surface of the upper die is parallel to the flat surface of the at least one receiving member.

9. The die set as claimed in claim 1, comprising an auxiliary member in a plate shape being used between the lower die and the metal plate workpiece.

10. A working method using a die set for bending a metal workpiece, the die set comprising:

a lower die configured to receive the metal plate workpiece; and an upper die having a pressing surface configured to press the metal plate workpiece against the lower die, the lower die including:

a lower movable part being slidable in a same direction as a moving direction of the upper die, the lower movable part having a first end and a second end, wherein the first end and the second end extending in a longitudinal direction of the lower die and are opposite to each other in a transverse direction which is transverse to the moving direction and the longitudinal direction;

a reaction force generating member elastically supporting the lower movable part from below; and at least one receiving member positioned at each of the first end and the second end of the lower movable part, wherein the pressing surface of the upper die has a curved convex surface, the lower movable part has an opposing surface which is opposite to the pressing surface and is curved from the first end to the second end of the lower movable part, the opposing surface being defined by a complex curve defined by, in sequence, a first convex end part at the first end, a concave portion curvedly extending from the first convex end part, and a second convex end part at the second end extending from the concave portion, the concave portion has a cross section curved in an arc shape in the transverse direction, and a radius of curvature of the concave portion is equal to or larger than a radius of curvature of the curved convex surface of the pressing surface, wherein the working method comprises:

a process of placing the metal plate workpiece on the lower die, a process of pressing the metal plate workpiece by the upper die, and a process of moving downward the lower die and the upper die while the metal plate workpiece is urged by the reaction force generating member under reaction force in a direction opposite to the moving direction of the upper die.

11. A working method using a die set for bending a metal workpiece, the die set comprising:

a lower die configured to receive the metal plate workpiece; and an upper die having a pressing surface configured to press the metal plate workpiece against the lower die, the lower die including:

a lower movable part being slidable in a same direction as a moving direction of the upper die, the lower movable part having a first end and a second end, wherein the first end and the second end extending in a longitudinal direction of the lower die and are opposite to each other in a transverse direction which is transverse to the moving direction and the longitudinal direction;

a reaction force generating member elastically supporting the lower movable part from below; and at least one receiving member positioned at each of the first end and the second end of the lower movable part, wherein the pressing surface of the upper die has a curved convex surface, the lower movable part has an opposing surface which is opposite to the pressing surface and is curved from the first end to the second end of the lower movable part, the opposing surface has being defined by a complex curve defined by, in sequence, a first convex end part at the first end, a concave portion curvedly extending from the first convex end part, and a second convex end part at the second end extending from the concave portion, the concave portion has a cross section curved in an arc shape in the transverse direction, and a radius of curvature of the concave portion is equal to or larger than a radius of curvature of the curved convex surface of the pressing surface, wherein the working method comprises:

a process of placing an auxiliary member and the metal plate workpiece on the lower die, a process of pressing the metal plate workpiece by the upper die, a process of moving downward the lower die and the upper die while the auxiliary member is urged by the reaction force generating member under reaction force in a direction opposite to the moving direction of the upper die.

* * * * *